US009926737B2

(12) United States Patent
Wanjohi

(10) Patent No.: US 9,926,737 B2
(45) Date of Patent: Mar. 27, 2018

(54) DELIVERY DOOR

(71) Applicant: Samuel Solomon Wanjohi, Hendersonville, TN (US)

(72) Inventor: Samuel Solomon Wanjohi, Hendersonville, TN (US)

( * ) Notice: Subject to any disclaimer, the term of this patent is extended or adjusted under 35 U.S.C. 154(b) by 0 days.

(21) Appl. No.: 14/148,406

(22) Filed: Jan. 6, 2014

(65) Prior Publication Data

US 2014/0190081 A1 Jul. 10, 2014

Related U.S. Application Data

(60) Provisional application No. 61/749,164, filed on Jan. 4, 2013.

(51) Int. Cl.

| | |
|---|---|
| ***E06B 7/32*** | (2006.01) |
| ***E06B 1/52*** | (2006.01) |
| ***E06B 3/36*** | (2006.01) |
| ***A47G 29/126*** | (2006.01) |
| ***A47G 29/14*** | (2006.01) |
| ***A47G 29/22*** | (2006.01) |
| *E06B 7/16* | (2006.01) |
| *E06B 9/04* | (2006.01) |
| *E06B 9/11* | (2006.01) |
| *E06B 9/68* | (2006.01) |

(52) U.S. Cl.

CPC ..... *E06B 7/32* (2013.01); *A47G 29/126* (2013.01); *A47G 29/141* (2013.01); *A47G 29/22* (2013.01); *E06B 1/52* (2013.01); *E06B 3/36* (2013.01); *A47G 2029/149* (2013.01); *E06B 7/16* (2013.01); *E06B 9/04* (2013.01); *E06B 9/11* (2013.01); *E06B 9/68* (2013.01); *E06B 2009/6818* (2013.01)

(58) Field of Classification Search

CPC ..... E06B 7/28; E06B 7/30; E06B 7/32; A47G 29/14; A47G 29/141; A47G 29/20; A47G 29/28; A47G 29/22; A47G 29/146

USPC ..... 49/70, 98, 380, 171, 62, 169

See application file for complete search history.

(56) References Cited

U.S. PATENT DOCUMENTS

| | | | | |
|---|---|---|---|---|
| 1,671,611 A * | 5/1928 | Rossman | ..... | 232/43.4 |
| 1,810,784 A * | 6/1931 | Pavelka | ..... | 220/476 |
| 1,901,303 A * | 3/1933 | Keil | ..... | 49/70 |
| 5,161,328 A * | 11/1992 | Traue | ..... | 49/171 |

(Continued)

FOREIGN PATENT DOCUMENTS

| | | | | |
|---|---|---|---|---|
| GB | 118214 A * | 8/1918 | ..... | A47G 29/14 |

*Primary Examiner* — Jerry E Redman
*Assistant Examiner* — Catherine A Kelly
(74) *Attorney, Agent, or Firm* — Dunlap Bennett & Ludwig PLLC

(57) ABSTRACT

A delivery door may include a frame having a slot, an interior flange and an exterior flange. A panel may be attached to the frame and comprise a closed configuration and an open configuration. A securing device may be connected to the frame and the panel. The securing device may be a remote accessed internet enabled lock assembly. In certain embodiments, the panel may have a handle and a stopper. The panel may also be motorized. The delivery door may include a receptacle attached to the internal flange and the frame. The delivery door may be attached to a cut out portion of the structure. The securing device may be controlled from a wireless device.

4 Claims, 4 Drawing Sheets

(56) References Cited

U.S. PATENT DOCUMENTS

| | | | | |
|---|---|---|---|---|
| 5,287,654 | A * | 2/1994 | Davlantes | A01K 1/035 47/56 |
| 7,246,562 | B2 * | 7/2007 | Lee et al. | 109/73 |
| 7,945,032 | B2 * | 5/2011 | Elberbaum | 379/102.06 |
| 2003/0006275 | A1 * | 1/2003 | Gray | 232/19 |
| 2003/0204996 | A1 * | 11/2003 | Gillett | 49/169 |
| 2007/0193834 | A1 * | 8/2007 | Pai | G08B 25/008 186/3 |
| 2008/0036611 | A1 * | 2/2008 | Noblitt | 340/573.3 |
| 2013/0017812 | A1 * | 1/2013 | Foster | H04L 12/2825 455/417 |
| 2013/0036672 | A1 * | 2/2013 | Westerfield | 49/62 |
| 2014/0090299 | A1 * | 4/2014 | Brown | 49/13 |

* cited by examiner

DELIVERY DOOR

CROSS-REFERENCE TO RELATED APPLICATION

This application claims the benefit of U.S. provisional application No. 61/749,164, filed Jan. 4, 2013, the contents of which are herein incorporated by reference.

BACKGROUND OF THE INVENTION

The present invention relates to doors and more particularly a delivery door used to provide access into private properties for the delivery or collection of parcels, and more particularly through walls, doors and other structural facades, when no one is present to grant access.

People when not home or in the office have difficulty in having parcels delivered or collected in a safe and secure way without granting the delivery or collection person access into the property.

With the rise in convenience services such as online shopping and home collection and return of laundry and dry-cleaning and the like, a solution is needed for such deliveries and collections to occur safely without anyone being present at the property to grant access.

As can be seen, there is a need for a delivery door that allows access and egress of parcels and items through a closed entrance door or wall of a residential home, commercial building and the like, without granting access to the person collecting or delivering the said parcel.

SUMMARY OF THE INVENTION

In one aspect of the present invention, a delivery door comprises: a frame having a slot, an interior flange and an exterior flange; a panel that connects to the frame, wherein the panel comprises an opened configuration and a closed configuration; and a securing device connected to the frame and the panel.

In another aspect of the present invention, a delivery door comprises: a frame having a slot, an interior flange and an exterior flange; a panel comprising a stopper and a handle, wherein the panel connects to the frame, wherein the panel comprises an opened configuration and a closed configuration; and a remote accessed internet enabled lock assembly connected to the frame and the panel, wherein the remote accessed internet enabled lock assembly is controlled by a wireless device.

In another aspect of the present invention, a method of allowing delivery access to a secured area through a closed structure without granting access to the person delivering a parcel comprises: producing a cutout on a structure; fitting a delivery door into the cutout on the structure, wherein the delivery door comprises a frame having a slot, an interior flange and an exterior flange; a panel that moves along the slot of the frame, wherein the panel has a handle and a stopper; and a remote accessed internet enabled lock assembly connected to the frame and the panel, wherein the remote accessed internet enabled lock assembly comprises a locked position and an unlocked position, wherein the locked position comprises a part of the remote accessed internet enabled lock assembly making contact with a lock receiver attached to the panel, wherein the unlocked position comprises breaking contact with the lock receiver on the panel; communicating with and operating the remote accessed internet enabled lock using a wireless device through a program product including a machine-readable program code; registering a delivery; notifying an individual in possession of the wireless device that a delivery is requested; shifting the remote accessed internet enabled lock to the unlocked configuration using the wireless device; opening the panel and placing the parcel inside of the structure; closing the panel; and shifting the remote accessed internet enabled lock to the locked configuration from the wireless device.

These and other features, aspects and advantages of the present invention will become better understood with reference to the following drawings, description and claims.

DETAILED DESCRIPTION OF THE INVENTION

The following detailed description is of the best currently contemplated mode of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a delivery door that may include a frame having a slot, an interior flange and an exterior flange. A panel may be attached to the frame and comprise a closed configuration and an open configuration. A securing device may be connected to the frame and the panel. The securing device may be a remote accessed internet enabled lock assembly. In certain embodiments, the panel may have a handle and a stopper. The panel may also be motorized. The delivery door may include a receptacle attached to the internal flange and the frame. The delivery door may be attached to a cut out portion of a structure. The securing device may be controlled from a wireless device.

The present invention may be fitted onto an external door during manufacture of the door. The delivery door fitted onto an external door during manufacture may allow access and exit of parcels into and out off a residential home, commercial building and the like, by use of a wireless device. In certain embodiments, the delivery door may be retrofitted onto an existing door, and the like, by a cutout or opening being made into the existing door.

The present invention may be fitted onto a wall or other structural facade during construction of the structure. The delivery door fitted onto the façade of a structure during construction may allow access and exit of parcels into and out off the structure by use of a wireless device. In certain embodiments, the delivery door may be retrofitted onto an existing structure or the like by a cutout or opening being made into the existing structure.

The present invention may include at least one computer with a user interface. The computer may include any computer including, but not limited to, a desktop, laptop, and smart device, such as, a tablet and smart phone. The computer may include a program product including a machine-readable program code for causing, when executed, the computer to perform steps. The program product may include software which may either be loaded onto the computer or accessed by the computer. The software may include an application on a wireless device such as a smartphone or tablet. The software may be accessed by the computer using a web browser, by a wireless device using an application, a text message or the like. The computer may access the software using an internet connection, internet, extranet, intranet, host server, internet cloud and the like.

Figure 1:
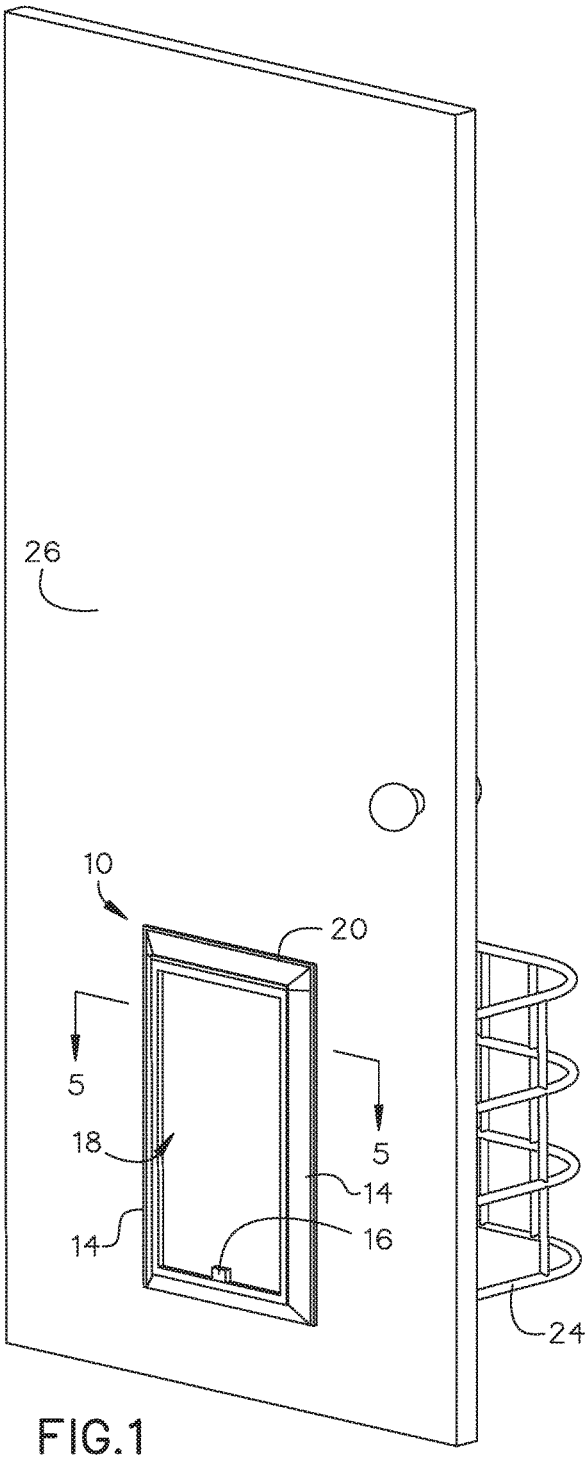
FIG. 1 is an exterior perspective view of an exemplary embodiment of the present invention in use in a closed configuration.
Figure 2:
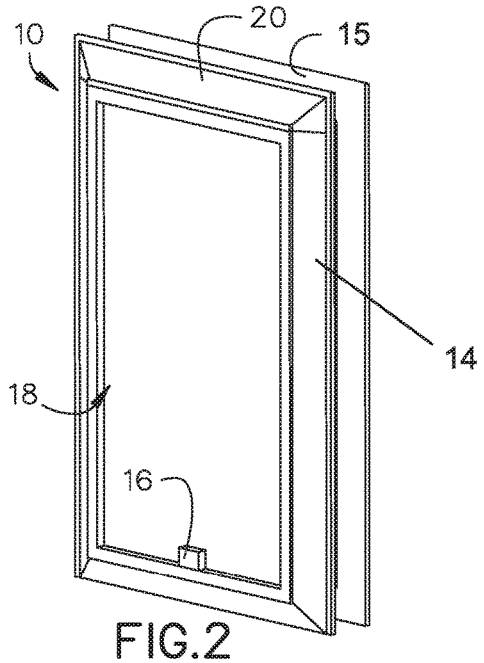
FIG. 2 is a front/exterior perspective view of an exemplary embodiment of the present invention shown in a closed configuration.
Figure 3:
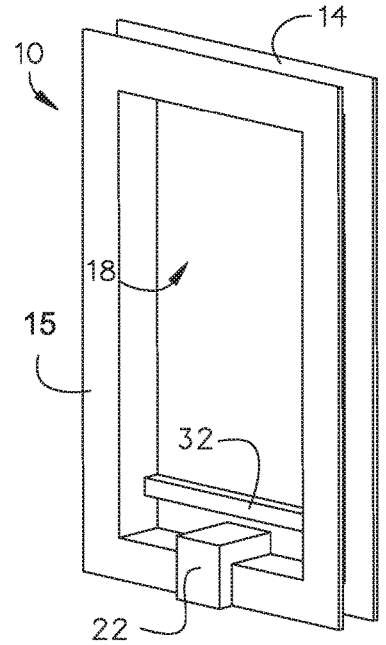
FIG. 3 is a back/interior perspective view of an exemplary embodiment of the present invention shown in closed configuration.
Figure 4:
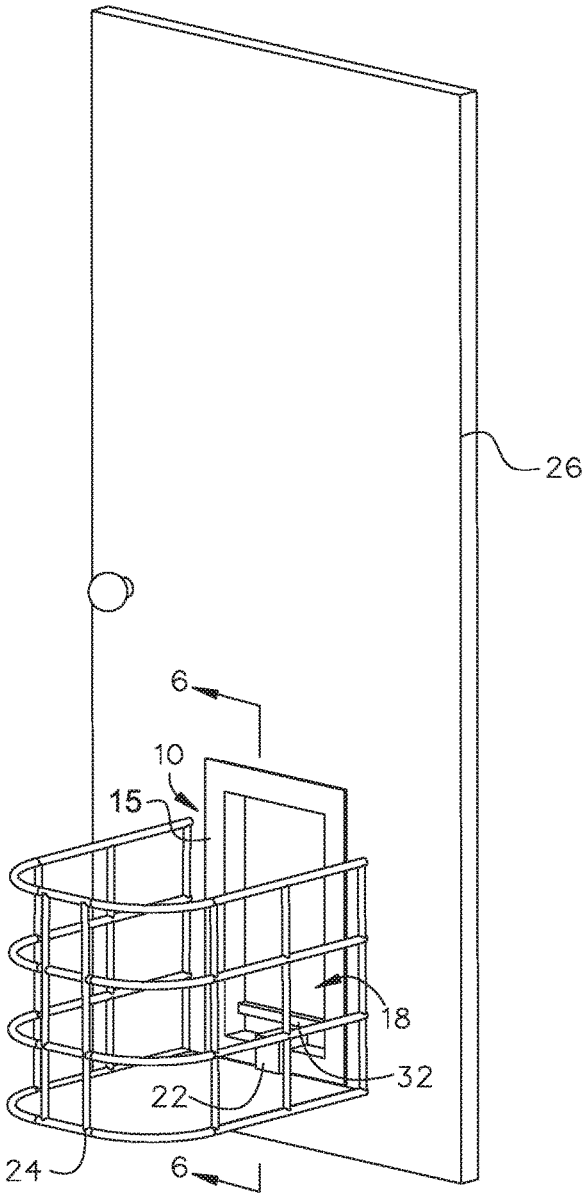
FIG. 4 is an interior perspective view of an exemplary embodiment of the present invention in use in closed configuration.
Figure 6:
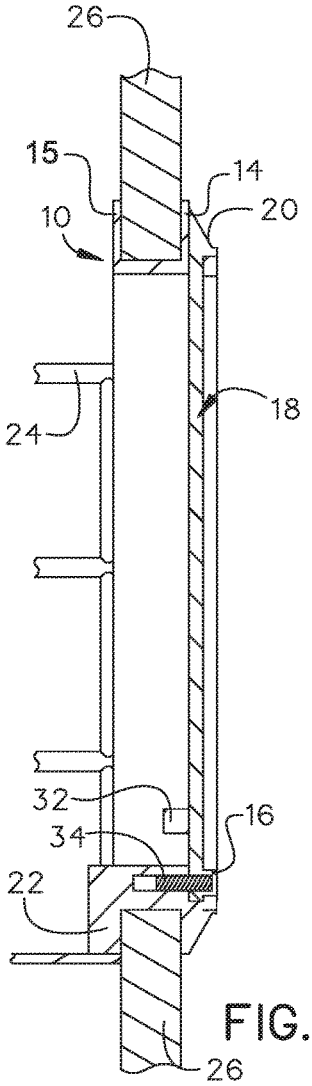
FIG. 6 is a section detail view of an exemplary embodiment of the present invention along line 6-6 in FIG. 4.
Figure 5:
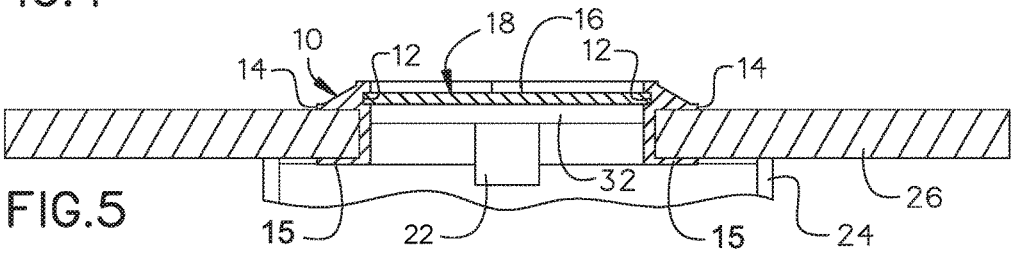
FIG. 5 is a section view of an exemplary embodiment of the present invention along line 5-5 in FIG. 1.
Figure 7:
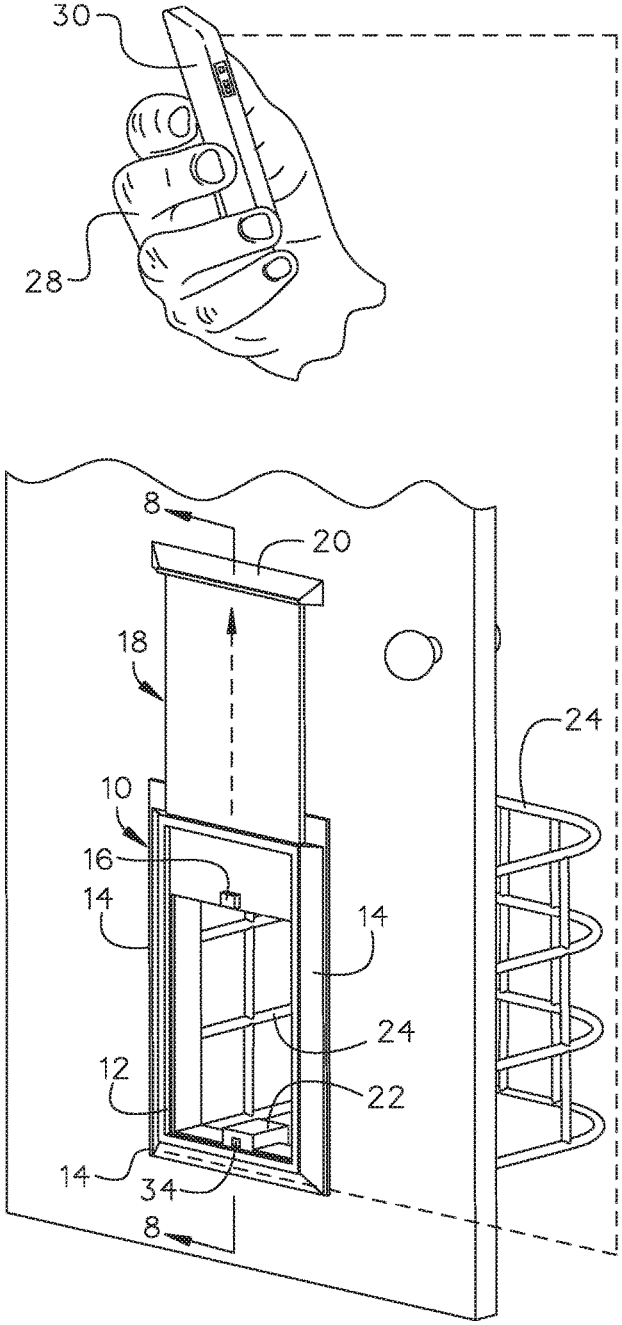
FIG. 7 is an exterior perspective view of an exemplary embodiment of the present invention in use in an open configuration.
Figure 8:
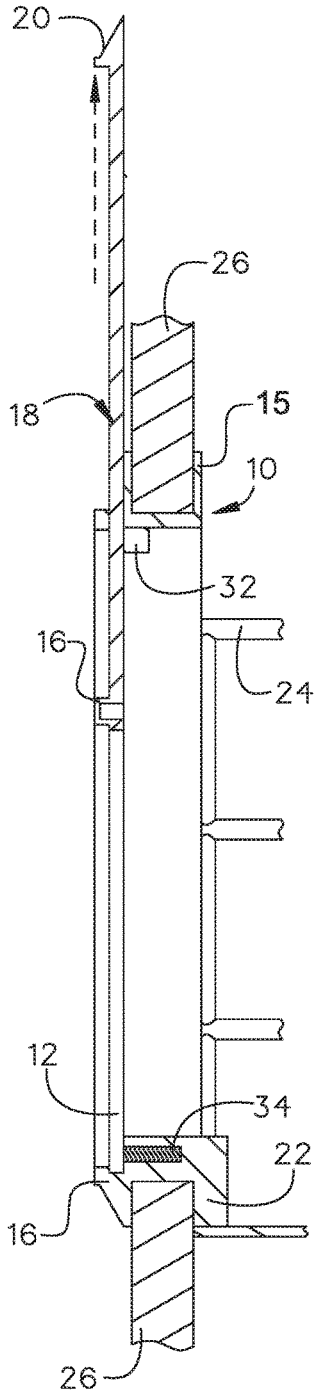
FIG. 8 is a section detail view of an exemplary embodiment of the present invention along line 8-8 in FIG. 7.
Figure 9:
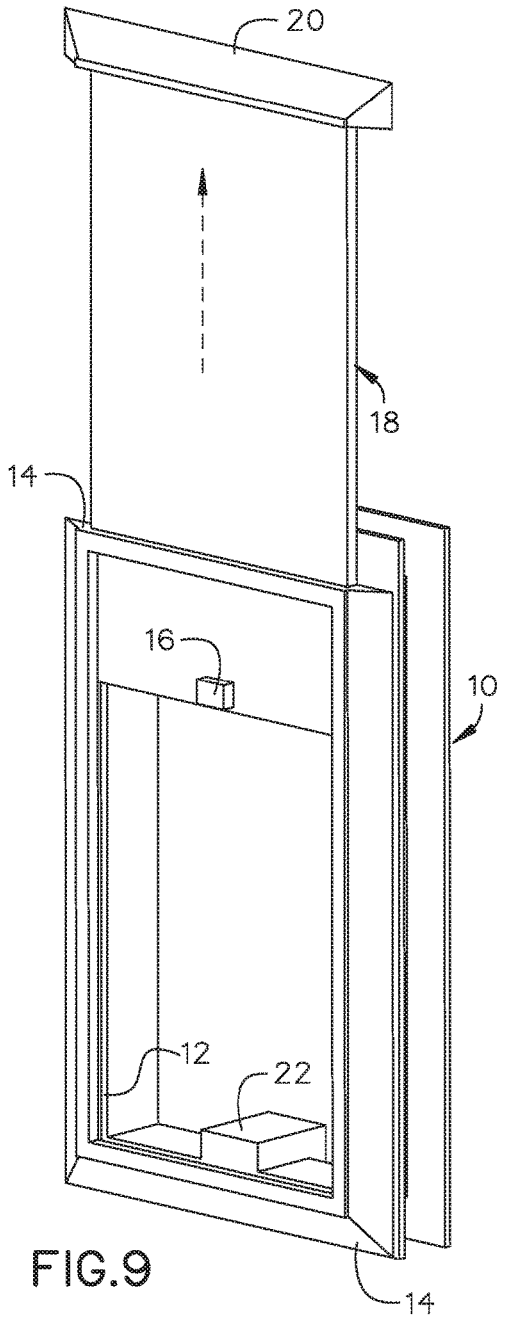
FIG. 9 is a front/exterior perspective view of an exemplary embodiment of the present invention shown in open configuration.
Figure 10:
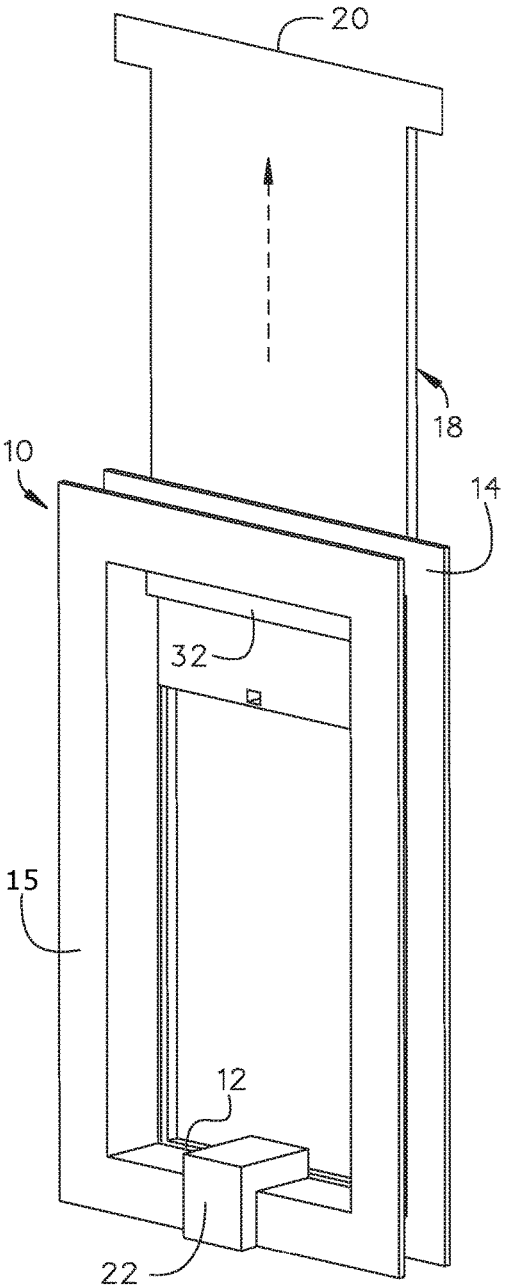
FIG. 10 is a back/interior perspective view of an exemplary embodiment of the present invention shown in open configuration.

As is illustrated in FIGS. 1 through 10, the delivery door may include a frame 10. The frame 10 may include a slot 12 along at least one side of the frame 10. The frame 10 may also include an interior flange 15 and an exterior flange 14. A panel 18 may be attached and slide along the slot 12 of the frame 10. A securing device may be connected to the frame 10 and the panel 18. In certain embodiments, the securing device may be a remote accessed internet enabled lock assembly. The interior flange 15 and the exterior flange 14 may hold the delivery door in place and improve its aesthetic appearance The remote accessed internet enabled lock assembly 22, 34 may be connected to the frame 10 and a lock receiver 16 attached to the panel 18. The lock assembly 22, 34 may include a base portion 22 and a lock pin 34. In certain embodiments, a handle 20 and a stopper 32 may be attached to the panel 18.

In certain embodiments, a wireless device 30 may be used to operate the remote accessed internet enabled lock 22, 34 to cause the locking of the panel 18 against the frame 10. The locking action may be caused by a part of the remote accessed internet enabled lock 22, 34 making contact with the lock receiver 16. The unlocking action may be caused by a part of the remote accessed internet enabled lock 22, 34 breaking contact with the lock receiver 16. The delivery door may be attached to a structure such as an entrance door 26, wall, structural façade or the like.

In certain embodiments, an individual 28, such as a homeowner or the like, may allow for the present invention to be included in their location. When a delivery person uses a doorbell or knocks or stands within a certain distance of the delivery door, the remote accessed internet enabled lock assembly may detect such an action and communicate with the individual's wireless device 30 such as a smartphone, or tablet through an application or SMS text message, alerting the individual 28 that someone is at the door 26 requesting access. The individual 28 may then unlock the panel 18 using an application or SMS text message or the like from a wireless device 30. The delivery person may then pull up the panel 18 using the handle 20 and may insert or extract the parcel through the opening. The delivery person may then push down on the handle 20 to the panel 18. The closing action may cause the remote accessed internet enabled lock 22, 34 to lock itself automatically. In certain embodiments, the homeowner may choose to lock it from their wireless device 30.

The remote accessed internet enabled lock assembly may be obtained from a supplier. The frame 10, the interior flange 15 and the exterior flange 14 may be made from a rigid, weatherproof material such as, rigid PVC, plastic, metal, wood composite material or the like. The manufacturing method of the frame 10, the interior flange 15, the exterior flange 14 and the handle 20 may be by cutting and joining linear profiles, by injection molding or the like. The panel 18 may be made of the same materials in a flat sheet form or a roller shutter form. The receptacle 24 may be made of plastic, metal with rubber coating or the like.

In certain embodiments, the panel 18 may have a stopper 32 so that the panel 18 may stop extending along the slot 12 once fully open. The slot 12 and panel 18 may be placed along the frame 10 so that the panel 18 may move in a vertical movement. In certain embodiments, the panel 18 may be positioned horizontally with the handle 20 on one side rather than at the top. The handle 20 may be pulled sideways to cause the panel 18 to open.

In certain embodiments, the panel 18 may be hingely connected to the frame 10 and the handle 20 may be relocated to an exterior face of the panel 18. The panel 18 may open in a swinging hinged action rather than in a vertically sliding action. In certain embodiments, the slot 12 may be omitted. In certain embodiments, the panel 18 may be segmented and may move by rolling up vertically while maintaining its path by using the slot 12 as a guide.

In certain embodiments a receptacle 24 may be attached to an interior flange 15 and the frame 10 so as to hold any parcel that might be delivered or require collection through the panel 18 of the present invention.

In certain embodiments, seals may be attached along an external edge of the frame 10 and external flange 14 in order to improve weather proofing. In certain embodiments, rather than manually opening the panel 18 using the handle 20, a motor may be incorporated and attached to the frame 10 or to the door 26 and used to automatically open and close the panel 18.

In certain embodiments, a hook may be added to an internal side of the structure 26 for hanging of items such as pressed laundry and dry cleaning when delivered or prior to collection. In certain embodiments, a sensor may be added to the motorized delivery door in conjunction with a transmitter placed on pets which may enable the delivery door to open when a pet approaches it, allowing it to double as a pet door.

In certain embodiments, an individual 28 may have a hole cut out in their front door, wall or other structural facade. The individual 28 may then install the delivery door. The individual may follow the remote accessed internet enabled lock manufacturer's instructions to install the application or use the SMS functionality to the wireless device 30. When a delivery or collection person next calls, the individual 28 may be alerted on their wireless device 30, such as a smart phone, to open the panel 18. Through a program product including a machine-readable program code, an application or SMS message may be sent to notify the individual 28 when access may be required. The sending of the notification may be initiated by the use of a doorbell, a knock, a sensing of motion or the like. The functionality to register a delivery through detecting the use of a doorbell, a knock or sensing motion may be a property of the remote accessed internet enabled lock 22, 34. The individual 28 may then unlock the remote accessed internet enabled lock 22, 34 using the wireless device 30. The remote accessed internet enabled lock 22, 34 may shift to an unlocked configuration by a part of it breaking contact with the lock receiver 16. The delivery or collection person may open the delivery door by lifting the handle 20, causing the panel 18 to move upwards. The parcel may be placed inside or removed from the inside of the property. The delivery person may close the panel 18 themselves by pushing down on the handle 20, the remote accessed internet enabled lock 22, 34 may detect closure of the panel 18 and cause itself to shift to a locked configuration by coming into contact with the lock receiver 16. In certain embodiments, the individual 28 may lock the delivery door using the wireless device 30, causing the remote accessed internet enabled lock 22, 34 to shift to the locked configuration by a part of it coming into contact with the lock receiver 16.

In certain embodiments, the delivery door may be used in any field where access may be required to be granted remotely such as to allow air into a room to avoid stuffiness and the like. In certain embodiments, the delivery door may be fitted onto any structure 26, structural façade such as a wall of a building, onto a door of an office or shop, onto the body of a vehicle and the like.

It should be understood, of course, that the foregoing relates to exemplary embodiments of the invention and that modifications may be made without departing from the spirit and scope of the invention as set forth in the following claims.

What is claimed is:

1. A delivery system comprising:

a door secured within a doorway of a structure, wherein the door separates an inside and an outside of the structure, wherein the door comprises an opening therethrough;

a frame comprising an exterior flange and an interior flange each having a top portion, a bottom portion and sides, wherein the frame is secured to the door within the opening so that the exterior flange is on the outside and the interior flange is on the inside, wherein the frame comprises a slot formed within an inner perimeter of the exterior flange at least along the top portion and the sides;

a panel slidably engaged within the slot and comprising an outer surface, and an inner surface, wherein an aperture is formed through the inner surface forming a lock receiver, and a stopper is affixed to and protruding from the inner surface, wherein the outer surface is faced towards the outside, and the inner surface is faced towards the inside, wherein the panel comprises an open position and a closed position, wherein the open position comprises the panel sliding upwards until the stopper abuts the top portion of the exterior flange so that the opening is exposed and the closed position comprises the panel covering the opening;

a receptacle affixed to the door on the inside of the structure and positioned to at least partially surround the opening of the door;

a locking assembly comprising a base portion secured to the interior flange and a lock pin disposed within the base portion, wherein the locking assembly comprises a locked position and an unlocked position, wherein the locked position comprises the lock pin disposed within the lock receiver of the panel and the unlocked position comprises the lock pin disposed outside of the lock receiver of the panel; and a wireless device wirelessly connected to the locking assembly and operable to activate the locking assembly, thereby transitioning the locking assembly from the locked position to the unlocked position, wherein the unlocked position allows the panel to be openable from the outside of the structure.

2. The delivery system of claim 1, further comprising a handle attached to the panel and extending from the outer surface of the panel.

3. The delivery system of claim 1, wherein the wireless device is wirelessly connected to the locking assembly by a wireless network.

4. The delivery system of claim 3, wherein the wireless network is connected to the internet.

* * * * *